US008435020B2

(12) United States Patent
Amano

(10) Patent No.: US 8,435,020 B2
(45) Date of Patent: May 7, 2013

(54) OIL-FREE SCREW COMPRESSOR

(75) Inventor: Yasushi Amano, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 253 days.

(21) Appl. No.: 13/056,375

(22) PCT Filed: Jun. 25, 2009

(86) PCT No.: PCT/JP2009/061601

§ 371 (c)(1),
(2), (4) Date: Jan. 28, 2011

(87) PCT Pub. No.: WO2010/013561

PCT Pub. Date: Feb. 4, 2010

(65) Prior Publication Data

US 2011/0135528 A1 Jun. 9, 2011

(30) Foreign Application Priority Data

Jul. 29, 2008 (JP) ..... 2008-194911

(51) Int. Cl.
*F01C 1/16* (2006.01)
*F03C 2/00* (2006.01)
*F03C 4/00* (2006.01)

(52) U.S. Cl.
USPC ..... 418/201.1; 418/88; 418/97; 418/98; 418/99

(58) Field of Classification Search ..... 418/201.1, 418/206.1, 206.6–206.8, 88–89, 97–99
See application file for complete search history.

(56) References Cited

U.S. PATENT DOCUMENTS

| | | | | |
|---|---|---|---|---|
| 3,975,123 | A * | 8/1976 | Schibbye | 418/97 |
| 4,213,307 | A * | 7/1980 | Watson | 62/192 |
| 4,394,113 | A | 7/1983 | Bammert | |
| 5,727,936 | A * | 3/1998 | Eriksson et al. | 418/97 |
| 5,957,676 | A * | 9/1999 | Peeters | 418/97 |
| 6,095,780 | A * | 8/2000 | Ernens | 418/201.1 |
| 6,302,667 | B1 * | 10/2001 | Timuska et al. | 418/201.1 |
| 7,165,949 | B2 * | 1/2007 | Firnhaber | 418/201.1 |
| 7,413,419 | B2 * | 8/2008 | De Smedt et al. | 417/410.4 |
| 2008/0260562 | A1 * | 10/2008 | Van Der Heggen et al. | 418/201.1 |

FOREIGN PATENT DOCUMENTS

| | | | | |
|---|---|---|---|---|
| JP | 56 88986 | | 7/1981 | |
| JP | 06129371 | A * | 5/1994 | 418/201.1 |
| JP | 2001 317478 | | 11/2001 | |
| JP | 2007 132243 | | 5/2007 | |

OTHER PUBLICATIONS

International Search Report issued Jul. 28, 2009 in PCT/JP09/061601 filed Jun. 25, 2009.

* cited by examiner

*Primary Examiner* — Theresa Trieu

(74) *Attorney, Agent, or Firm* — Oblon, Spivak, McClelland, Maier & Neustadt, L.L.P.

(57) ABSTRACT

A screw compressor (10) is provided with shaft seal sections (28, 41) located on opposite sides of a compression chamber (24) of a screw rotor (25), to prevent mixing of oil in bearings (27, 39, 40) into the compression chamber (24) and leakage of process gas from the compression chamber (24). A suction-opening return line (52) interconnects the shaft seal section (41) on the discharge side of the compression chamber (24) and a suction opening (17) of the compressor body (11). A supply-process-gas communicating line (61) interconnects the suction opening (17) of the compressor body (11) and the upper part of the oil supply tank (13), and a shaft seal section (53) divides the inside of the compressor body (11) and an atmospheric environment.

3 Claims, 5 Drawing Sheets

OIL-FREE SCREW COMPRESSOR

TECHNICAL FIELD

The present invention relates to an oil-free screw compressor.

BACKGROUND ART

The system of a screw compressor is roughly classified into two different types, that is, an oil-flooded screw compressor in which a lubricating oil is supplied to a rotor compression chamber and an oil-free screw compressor in which no oil is supplied to the rotor compression chamber.

FIG. 4 shows an oil-flooded screw compressor 100. In this oil-flooded screw compressor 100, a pair of male and female screw rotors (not shown) inside a compressor main unit 102 are driven by a motor 101 so that a process gas from a process-gas supply source 103 is compressed and supplied to a supply end 105 through an oil recovery device 104. The oil, separated in the oil recovery device 104, is supplied to bearings (not shown) and a compression chamber (not shown) of the compressor main unit 102 through an oil cooler 106, a pump 107 and a filter 108. In the oil-flooded screw compressor 100, the lubricating oil is supplied to the compression chamber (not shown) of a rotor (not shown) so that the process gas is cooled, deriving a merit that a high compression ratio can be achieved by compression at the first stage.

In the case when a gas containing much heavy hydrocarbon gas, such as propane, butane and hexane, is used as the process gas, the heavy hydrocarbon gas is dissolved in the lubricating oil, causing a reduction in the viscosity of the lubricating oil and damages to the bearing. Moreover, in the case when the heavy hydrocarbon gas is compressed to cause a pressure increase, although the gas is liquefied at a low temperature state, it is not liquefied at a high temperature state. In order to increase a discharge temperature so as not to liquefy the heavy hydrocarbon gas, it is necessary to increase the temperature of the lubricating oil supplied to the compression chamber (not shown). However, the increase in the temperature causes a reduction in viscosity of the lubricating oil and the subsequent damages to the bearing. In contrast, in the case when the temperature of the lubricating oil is lowered and the discharge temperature is also lowered so as to ensure the viscosity of the lubricating oil, the heavy hydrocarbon gas is condensed inside the oil recovery device 104 to cause a rise of the liquid level, resulting in a problem of scattering of the lubricating oil toward the succeeding flow.

FIG. 5 shows an oil-free screw compressor 120. In this oil-free screw compressor 120, screw rotors 123 and 124 inside a compressor main unit 122 are driven by a motor 121 so that a process gas from a process-gas supply source 125 is compressed and supplied to a supply end 126. On the other hand, a lubricating oil inside an oil tank 127 is supplied to bearings 130 through an oil pump 128 and a filter 129, and is then returned to the tank by gravity. In the oil-free screw compressor 120, since no oil is used for lubricating the screw rotors 123 and 124 and maintaining an air-tightness of the compression chambers (not shown), shaft-sealing seals 133 at four positions are required for separating the compression chamber (not shown) from oil injection portions 132 of the bearings 130 and timing gears 131. As the seals, those which use carbon, or gas seals may be used. Since the shaft-sealing portions 133 at four positions are required, reliability against seal leakage is low, and the compressor becomes expensive.

DISCLOSURE OF THE INVENTION

Problems to be Solved by the Invention

The present invention relates to a screw compressor for a process gas in which a process gas containing much heavy hydrocarbon is compressed, and its objective is to provide an oil-free screw compressor which is provided with a shaft-sealing device that is inexpensive and has high reliability, and is capable of preventing bearing damages due to a reduction of viscosity in lubricating oil caused by dissolution of a heavy hydrocarbon gas into the lubricating oil to be used in the bearings of the screw compressor and also preventing the heavy hydrocarbon from being liquefied in a discharge system.

Means for Solving the Problems

In order to solve the above-mentioned problems, an oil-free screw compressor of the present invention, which is a screw compressor provided with: a compressor main unit having a pair of male and female screw rotors that are disposed horizontally, with shafts of the screw rotors being supported by bearings; anoil supply tank that stores oil; an oil supply line that supplies the oil in the oil supply tank to oil injection portions, such as the bearings and the like of the compressor main unit; and an oil recovery line that collects the oil supplied to the oil injection portions such as the bearings and the like from the compressor main unit, is designed so that the screw compressor further includes: shaft-sealing portions that are placed on the two sides of a compressor chamber of the screw rotor in an axial direction thereof, and prevent the oil supplied to the oil injection portions, such as the bearings and the like, from being mixed into the compressor chamber of the screw rotor, as well as preventing a process gas from leaking from the compressor chamber; a suction port return line that allows the shaft-sealing portion on the discharge side of the compressor chamber and a suction port of the compressor main unit to communicate with each other; a supply process gas communication line that allows the suction port of the compressor main unit and an upper portion of the oil supply tank to communicate with each other; and an inside/outside shaft-sealing portion that separates the inside of the compressor main unit from the atmospheric air.

In accordance with this structure, the shaft-sealing portions, which prevent the oil supplied to the oil injection portions, such as the bearings and the like, from being mixed into the compressor chamber of the screw rotor, as well as preventing a process gas from leaking from the compressor chamber, are placed on the two sides of the compressor chamber of the screw rotor in an axial direction thereof, and the suction port return line that allows the shaft-sealing portion on the discharge side of the compressor chamber and the suction port of the compressor main unit to communicate with each other is installed. Thus, the process gas on the discharge side of the compression chamber flows out to the suction port return line from the shaft-sealing portion, without passing through the shaft-sealing portion, thereby making it possible to prevent leakage. Moreover, it is possible to separate the inside of the compressor main unit from the atmospheric air, by using a single inside/outside shaft-sealing portion placed at only one position.

The oil-free screw compressor is preferably further provided with a gas-transfer line that transfers a gas flow to the shaft-sealing portions on the two sides, and the gas is preferably a gas having a discharge pressure that is compressed by the compressor main unit. In accordance with this structure, by transferring the gas compressed by the compressor main unit so as to have the discharge pressure to the shaft-sealing portion between the compression chamber and the bearing of the screw rotor through the gas-transfer line, the compression chamber and the bearing of the screw rotor can be separated from each other.

The oil-free screw compressor is preferably further provided with a gas-transfer line that transfers a gas flow to the shaft-sealing portions on the two sides, and the gas is preferably a gas, such as a nitrogen gas, a fuel gas or the like, that gives no influences to the process gas. With this structure, by transferring a gas, such as a nitrogen gas, a fuel gas or the like, that gives no influences to the process gas, to the shaft-sealing portion between the compression chamber and the bearing of the screw rotor by using the gas-transfer line, the compression chamber and the bearing of the screw rotor can be separated from each other.

Effects of the Invention

In accordance with the present invention, by using the shaft-sealing portions installed on the two sides of the rotor compression chamber, it is possible to prevent lubricating oil from being mixed into a compressed gas. With this arrangement, the compressor of the present invention can be utilized as an oil-free screw compressor in which no oil is mixed into the compressed gas. Moreover, it is also possible to prevent a leakage of a gas from the rotor compression chamber by using the shaft-sealing portion. By preparing the shaft-sealing portion as a simple structure such as a carbon ring seal or the like, it becomes possible to reduce the costs of shaft-sealing.

By reducing the shaft-sealing positions for separating the inside of the compressor main unit from the atmospheric air from four positions to one position, it becomes possible to reduce the costs of shaft-sealing, and by reducing the number of the shaft-sealing positions, it is possible to improve reliability against leakage.

Moreover, by averaging the pressure of the oil tank by introducing a pressure lower than the discharge pressure of the compressor main unit, the amount of dissolution of a heavy hydrocarbon gas to the lubricating oil is suppressed so that it is possible to prevent degradation of the viscosity. As a result, the bearing of the compressor main unit can be prevented from being damaged.

By utilizing a screw compressor as the oil-free screw compressor, since the temperature inside the compression chamber needs not to be reduced to a low level, it is possible to prevent the compressed gas in the discharge system from being liquefied.

By utilizing a gas that is compressed by the compressor main unit to have a pressure raised to the discharge pressure as a sealing gas used for sealing the inside of the compressor main unit, it becomes possible to positively prevent the lubricating oil from being mixed into the compression chamber, as well as preventing the process gas from leaking toward the bearing side.

By utilizing a gas, such as a nitrogen gas, a fuel gas or the like, that gives no influences to the process gas, as a sealing gas used for sealing the inside of the compressor main unit, even in the case of using a process gas containing a corrosive component, the process gas is prevented from being made in contact with the bearings, timing gears and the like so that it is possible to prevent them from corrosion.

EXPLANATION OF REFERENCE NUMERALS

Figure 1:
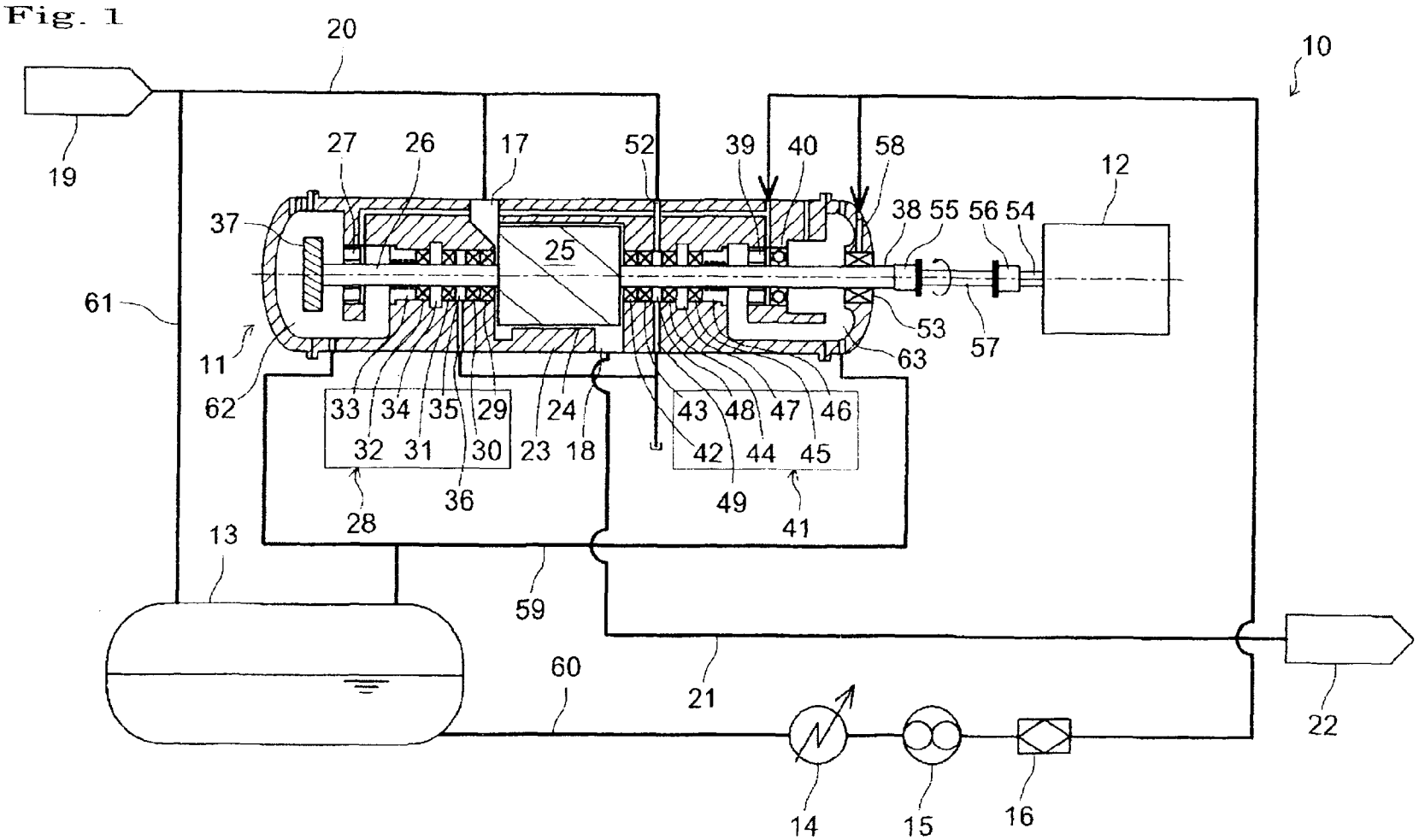
FIG. 1 is a diagram showing an oil-free screw compressor in accordance with a first embodiment of the present invention.

10, 70, 80 Oil-free screw compressor
11 Compressor main unit
13 Oil supply tank
17 Suction port
18 Discharge port
24 Rotor chamber (compression chamber)
25 Driving-side screw rotor
26, 38 Shaft
27, 39 Bearing (cylindrical roller bearing)
28, 41 Shaft-sealing portion
29, 30, 31, 32 Carbon ring seal
33, 46 labyrinth seal
34, 47 Gas-transfer chamber
35 Space portion
36, 49 Drain
40 Bearing (angular contact ball bearing)
42, 43, 44, 45 Carbon ring seal
48 Space portion
50, 51 Gas-transfer line
52 Suction port return line
53 Mechanical seal (inside/outside shaft-sealing portion)
58 Lubricant line
59 Oil recovery line
60 Oil supply line
61 Supply process gas communication line
62, 63 Oil storing chamber
71 Compression process gas return line
81 Inert gas supply source
82 Inert gas supply line

BEST MODE FOR CARRYING OUT THE INVENTION

Referring to Figures, embodiments of the present invention will be explained.

FIG. 1 shows an oil-free screw compressor 10 in accordance with first embodiment of the present invention. This oil-free screw compressor 10 is constituted by a compressor main unit 11, a motor 12 provided as a separated driving unit connected to the compressor main unit 11, an oil supply tank 13, an oil condenser 14, a pump 15 and a filter 16. The compressor main unit 11 is provided with a suction port 17 that sucks a process gas and a discharge port 18 that discharges the process gas. A process gas supply source 19 is communicated with the suction port 17 of the compressor main unit 11 through a process gas supply line 20. The discharge port 18 of the compressor main unit 11 is directed to a process gas supply end 22 by a compression process gas supply line 21.

The compressor main unit 11 is provided with a pair of male and female screw rotors engaged with each other that are housed in a rotor chamber 24 inside a compressor casing 23 so as to rotate therein, and in FIG. 1, only the driving-side screw rotor 25 is illustrated. The paired male and female screw rotors are disposed horizontally. In FIG. 1, the left side is referred to as a suction side and the right side is referred to as a discharge side.

A shaft 26 extending toward the suction port 17 side of the screw rotor 25 is supported on the compressor casing 23 by abearing (for example, cylindrical roller bearing) 27. Between the screw rotor 25 and the bearing 27, a shaft-sealing portion 28 is installed. The shaft-sealing portion 28 is provided with carbon ring seals 29, 30, 31 and 32 that reduce as much as possible a process gas from leaking from the compression chamber formed by the teeth groove portion (not shown) of the male rotor 25 and the female rotor (not shown) and the compressor casing 23, a labyrinth seal 33 that reduces as much as possible lubricating oil supplied to the bearing 27 from invading into the compression chamber 24 and a gas-transfer chamber 34 in which a gas flows so as to shaft-seal the shaft-sealing portion 28. That is, the shaft-sealing portion 28 is designed to prevent oil supplied to lubricating portions, such as the bearing 27, from being mixed into the compression chamber 24 of the screw rotor 25, and also prevent the process gas from the compression chamber 24 from leaking toward the bearing 27 side. In the shaft-sealing portion 28, two of the carbon ring seals 29 and 30 are disposed in succession from the screw rotor 25 toward the suction side. A space portion 35 is provided adjacent to the carbon ring seal 30. The carbon ring seal 31 is placed adjacent to the space portion 35. Next to the carbon ring seal 31, a gas-transfer chamber 34 is disposed. Next to the gas-transfer chamber 34, the carbon ring seal 32 is placed, and next to the carbon ring seal 32, the labyrinth seal 33 is further placed. A drain 36 for discharging oil is formed below the space portion 35. Moreover, a timing gear 37 is attached to the end portion of the shaft 26.

A shaft 38 extending on the discharge port 18 side of the screw rotor 25 is supported on the compressor casing 23 with a bearing (for example, cylindrical roller bearing) 39 and a bearing (thrust bearing, for example, angular contact ball bearing) 40. Between the screw rotor 25 and the bearing 39, a shaft-sealing portion 41 is installed. That is, the shaft-sealing portions 28 and 41 are positioned on both sides in the axial direction of the compression chamber 24 of the screw rotor 25. The shaft-sealing portion 41 is provided with carbon ring seals 42, 43, 44, and 45, a labyrinth seal 46 that reduces as much as possible lubricating oil supplied to the bearings 39 and 40 from invading into the compression chamber 24, and a gas-transfer chamber 47 in which a gas flows so as to shaft-seal the shaft-sealing portion 41. In other words, the shaft-sealing portion 41 is designed to prevent oil supplied to oil-supply portions, such as the bearings 39, 40, 53 and the like, from being mixed into the compression chamber 24 of the screw rotor 25, and also prevent the process gas supplied from the compression chamber 24 from leaking toward the bearings 39 and 40 sides. In the shaft-sealing portion 41, two of the carbon ring seals 42 and 43 are disposed successively from the screw rotor 25 side. A space portion 48 is provided adjacent to the carbon ring seal 43. A suction port return line 52 is connected to the space portion 48. The suction port return line 52 is designed to allow the shaft-sealing portion 41 on the discharge side of the compression chamber 24 and the suction port 17 of the compressor main unit 11 to communicate with each other. Next to the space portion 48, the carbon ring seal 44 is disposed. Next to the carbon ring seal 44, the gas-transfer chamber 47 is disposed. Next to the gas-transfer chamber 47, the carbon ring seal 45 is disposed, and next to the carbon ring seal 45, the labyrinth seal 46 is further disposed. Below the space portion 48, a drain 49 used for discharging oil is formed. At a position of the compressor casing 23 where the rotor shaft 38 penetrates, a mechanical seal (inside/outside shaft-sealing portion) 53 is installed. The mechanical seal 53 is designed to separate the inside of the compressor main unit 11 and the outside atmospheric air from each other. An oil injection line 58 is connected to the mechanical seal 53.

The timing gear 37 of the shaft 26 of the driving-side screw rotor 25 is meshed with a timing gear (not shown) attached to the shaft end portion of the other screw rotor (driven-side), not shown, to serve as a function to transmit its rotary force to the other screw rotor. The screw rotor on the driven side (not shown) is completely the same as the screw rotor 25 on the driving side in its structures from the timing gear 37 to the bearing 40. A shaft (not shown) of the screw rotor (not shown) on the driven side, which is extended toward the discharging side, is cut off at a position between the bearing 40 and the mechanical seal 53.

The motor 12 is disposed on the discharging side of the compressor main unit 11. The center of an output shaft (motor shaft) 54 extending so as to penetrate the center portion of its rotor (not shown) is placed coaxially on the center of the shaft 38 extending toward the discharging side of the screw rotor 25. A coupling 55 of the rotor shaft 38 and a coupling 56 of the motor shaft 54 which are separated members from each other are coupled to each other through a coupling shaft 57. In this case, the output shaft (motor shaft) 54 and the shaft 38 may be connected to each other with a speed-increaser or the like. Moreover, instead of the motor 12, an expander (expansion machine) may be used as the driving device.

The oil supply tank 13 is connected to the bearings 27, 39, 40 and the mechanical seal 53 of the compressor main unit 11 through an oil supply line 60 including an oil cooler 14, a pump 15 and a filter 16 in turn from the outlet. The oil supply tank 13 stores oil. The oil supply line 60 is connected to a flow passage of oil formed inside the casing 23 of the compressor main unit 11. The oil flow passage formed inside the casing 23 of the compressor main unit 11 is branched, and designed such that one of the branched flow passages is connected to the bearings 39 and 40, and the other branched flow passage being connected to the bearing 27. That is, oil of the oil supply tank 13 is supplied to oil-injection portions, such as the bearings 27, 39 and 40, of the compressor main unit 11 through the oil supply line 60. The oil supply tank 13 communicates with oil storing chambers 62 and 63 of the compressor main unit 11 through an oil recovery line 59. The oil, supplied to the oil-injection portions, such as the bearings 27, 39 and 40, is recovered from the compressor main unit 11 into the oil supply tank 13. The top face of the oil supply tank 13 and the process gas supply line 20 communicates with each other by a supply process gas communication line 61. Therefore, the suction port 17 of the compressor main unit 11 and the top portion of the oil supply tank 13 communicates with each other through the process gas supply line 20 and the supply process gas communication line 61.

In the oil-free screw compressor 10 having the above-mentioned structure, a process gas supplied from the process gas supply source 19 is sucked into the suction port 17 of the compressor main unit 11 through the process gas supply line 20. The process gas is compressed by the compressor main unit 11 and discharged from the discharge port 18. The compressed process gas, thus discharged, is supplied to the supply end 22 of the process gas, through the compression process gas supply line 21.

The oil, stored in the oil supply tank 13, is sent to the oil cooler 14 through oil-supply line 60, and is cooled. After that, the cooled oil is delivered by the pump 15 to the filter 16 so that dusts or the like are removed, and then supplied to the bearings 27, 39, 40 and the mechanical seal 53. After having been used as lubricating oil in the bearings 27, 39, 40 and the mechanical seal 53, the resulting oil is discharged from the oil storing chambers 62 and 63, and flows into the oil supply tank 13 through the oil recovery line 59.

The upper portion of the inside of the oil supply tank 13, which communicates with the process gas supply line 20 by the supply process gas communication line 61, is uniformly set to the same pressure as that of the process gas supply line 20, that is, the suction pressure of the compressor main unit 11. For this reason, the pressure is also exerted on the oil stored in the lower portion of the inside of the oil supply tank 13.

In order to prevent the process gas from leaking from the suction port 17 side of the compression chamber 24 of the screw rotor 25 toward the shaft 26 and to prevent the oil from being mixed into the compression chamber 24 from the bearing 27, the opposite side of the shaft-sealing portion 28 to the compression chamber 24 of the screw rotor 25 is made to have the same pressure as the suction pressure of the compression chamber 24 of the screw rotor 25. With this arrangement, no pressure difference occurs and no movements in the process gas and the oil take place. For this purpose, the oil storing chamber 62 surrounding the bearing 27 is preliminarily filled with the process gas having a suction pressure so that the oil to be supplied to the bearing 27 by the oil supply line 60 is maintained at the same pressure as the suction pressure. Thus, the lubricating oil never leaks into the suction port 17 side of the pressure chamber 24 of the screw rotor 25. Consequently, the shaft-sealing on the suction port 17 side of the compression chamber 24 of the screw rotor 25 can be achieved.

The discharge port 18 side of the compression chamber 24 of the screw rotor 25 is made to have a pressure higher than that of the suction port 17 because the compressed process gas is discharged therein. In the same manner as in the shaft 26 side, the opposite side of the shaft-sealing portion 41 to the compression chamber 24 of the screw rotor 25 is made to have the same pressure as the suction pressure of the compression chamber 24 of the screw rotor 25. With these structures, a pressure difference is generated on the two sides in the shaft 38 direction of the shaft-sealing portion 41. On the shaft 38 side, although the leakage of the process gas from the discharge port 18 side of the compression chamber 24 of the screw rotor 25 toward the shaft 38 and the mixing of the oil into the compression chamber 24 from the bearings 39 and 40 can be mostly prevented by the shaft-sealing portion 41, this function is not perfect because of the generation of the pressure difference on the two sides of the shaft-sealing portion 41. In order to obtain a better shaft-sealing effect, a process gas having a high pressure is made to flow out into the suction port return line 52 from the space portion 48 so as to reduce the pressure difference between the two sides of the shaft-sealing portion 41. Since the suction port return line 52, connected to the space portion 48, communicates with the suction port 17 of the compressor main unit 11, it has a pressure between the discharge pressure and the suction pressure of the screw rotor 25. For this reason, the leaked process gas having the discharge pressure flows toward the suction port return line 52 side having a relatively lower pressure than that of the inside of the shaft-sealing portion 41, and is returned to the suction port 17 of the compressor main unit 11. The pressure of the oil storing unit 63 is virtually the same as the suction pressure, and is slightly lower than the pressure of the space portion 48. However, since the carbon ring seal 44 inside the shaft-sealing portion 41, the gas-transfer chamber 47, the carbon ring seal 45 and the labyrinth seal 46 are located between the oil storing unit 63 and the space portion 48, the flow from the space portion 48 to the oil storing unit 63 is subjected to a higher resistance in comparison with the flow from the space portion 48 to the suction return line 52. For this reason, most of the process gas in the space portion 48 flow toward the suction return line 52. Consequently, no leakage of the process gas toward the bearing 39 side takes place. Moreover, even in the case when the oil, supplied to the bearings 39 and 40, is leaked toward the compression chamber 24 side beyond the labyrinth seal 46, since the oil supplied to the bearings 39 and 40 has the same pressure as the suction pressure, the leaked oil cannot reach the vicinity of the discharge portion 18 of the compression chamber 24 having a relatively high pressure. It is possible to prevent the supplied oil into the bearings 39 and 40 from being mixed into the compression chamber 23. With these structures, the shaft-sealing function from the process gas and oil on the discharge port 18 side of the compression chamber 24 of the screw rotor 25 can be achieved.

As described above, different shaft-sealing methods are taken between the shaft-sealing portion 28 on the suction port 17 side and the shaft-sealing portion 41 on the discharge port 18 side of the compression chamber 24 of the screw rotor 25, that is, the shaft-sealing methods that are different in that the shaft-sealing portion 28 has no lines such as the suction port return line 52 and the like, while the shaft-sealing portion 41 has the suction return line 52, are adopted. Thus, it is possible to prevent the process gas in the compression chamber 24 of the screw rotor 25 and the oil supplied to the bearings 27, 39 and 40 from passing through the shaft-sealing portions 28 and 41. In other words, by the shaft-sealing portions 28 and 41 installed on the two sides of the compression chamber 24 of the screw rotor 25, it becomes possible to prevent the lubricating oil from being mixed into the compressed gas. Moreover, the gas leakage from the compression chamber 24 can be prevented as well. With these structures, the compressor 10 relating to the present invention can be utilized as anon-free screw compressor 10 in which no oil is mixed into the compression gas. By utilizing the screw compressor 10 as the oil-free screw compressor 10, it is possible to prevent the compression gas in the discharge system from being liquefied because no temperature drop occurs. By preparing the shaft-sealing portions 28 and 41 as simple structures, such as carbon ring seals 29, 30, 31, 32, 42, 43, 44 and 45, it is possible to reduce the costs required for the shaft-sealing. In the compressor main unit 11, by maintaining the lubricating oil at the suction pressure, the shaft-sealing portions 28 and 41 can be simplified so that the shaft-sealing members that separate the inside of the compressor main unit 11 from the atmospheric air are reduced from four to one (mechanical seal 53). With this arrangement, it is possible to further reduce the costs required for the shaft-sealing, and also to improve reliability against leakage by the reduction of the shaft-sealing positions.

The amount of dissolution of heavy hydrocarbon gas into lubricating oil is approximately proportional to the pressure. Since the top face of the oil-supply tank 13 and the process gas supply line 20 are allowed to communicate with each other by the supply process gas communication line 61, the lubricating oil to be supplied to the bearings 27, 39, 40 and the mechanical seal 53 is maintained by a suction pressure of the compressor main unit 11. With this arrangement, the amount of dissolution of the heavy hydrocarbon into lubricating oil can be suppressed to a low level in comparison with a state in which the heavy hydrocarbon gas at the discharge pressure and the lubricating oil coexist, thereby making it possible to prevent a reduction in viscosity. As a result, damages to the bearings in the compressor main unit can be prevented.

Figure 2:
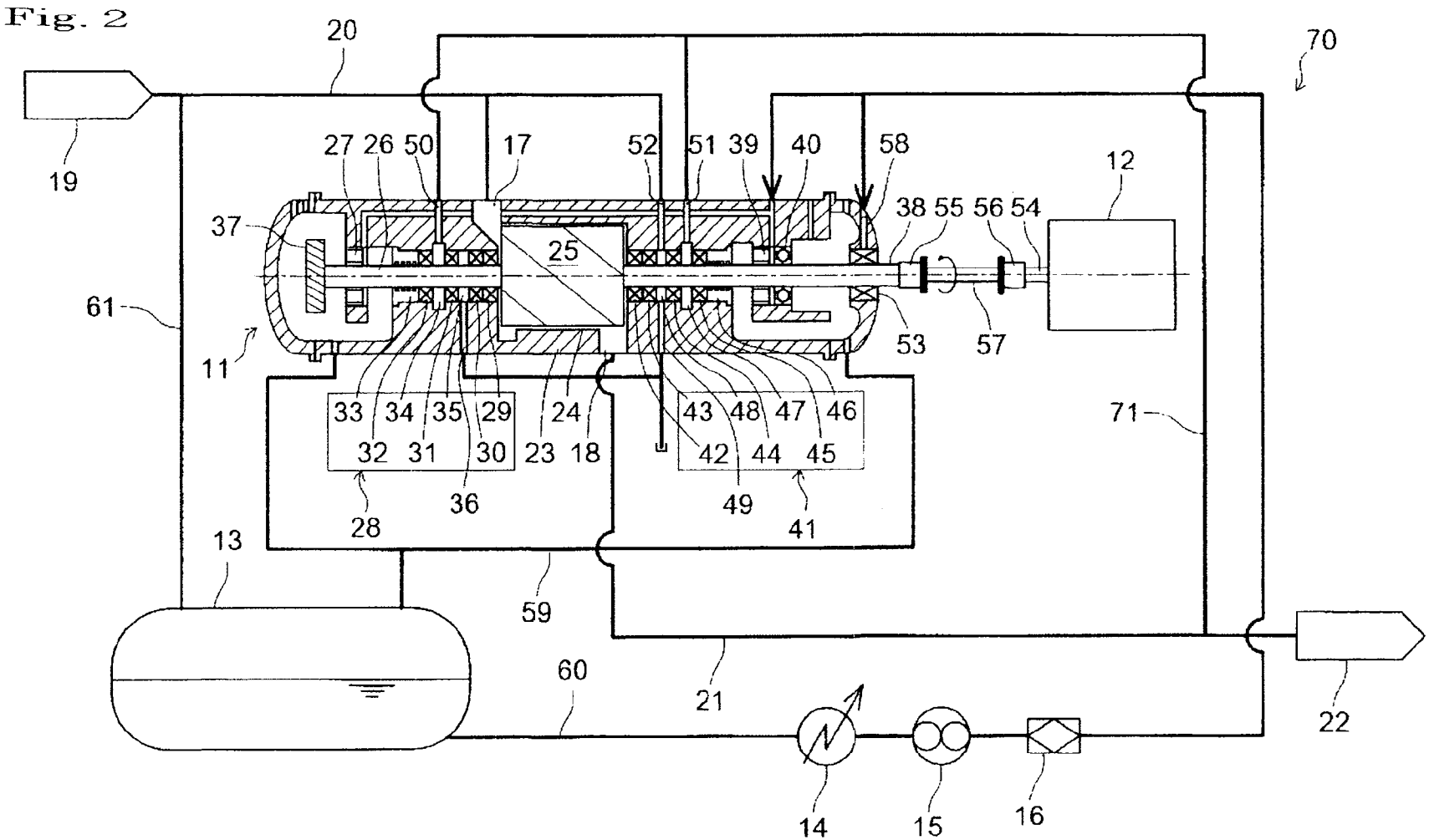
FIG. 2 is a diagram showing an oil-free screw compressor in accordance with a second embodiment of the present invention.

FIG. 2 shows an oil-free screw compressor 70 in accordance with a second embodiment of the present invention. In the present embodiment, those components that are the same as those of embodiment 1 are indicated by the same reference numerals and the description thereof will be omitted. The present embodiment is further provided with gas-transfer lines 50 and 51 that transfer gases to the shaft-sealing portions 28 and 41 on the two sides of the compression chamber 24. To the gas-transfer chamber 34 of the shaft-sealing portion 28, the gas-transfer line 50 is connected. To the gas-transfer chamber 47 of the shaft-sealing portion 41, the gas-transfer line 51 is connected. The gas-transfer line 50 and the gas-transfer line 51 communicate with the compression process gas supply line 21 through a compression process gas return line 71.

In the second embodiment, a process gas having a pressure raised to the discharge pressure in the compressor main unit 11 is transferred to the gas-transfer line 50 and the gas-transfer line 51. Thus, the gas-transfer chamber 34 and the gas-transfer chamber 47 are filled with the process gas at the discharge pressure (at least, higher than the suction pressure).

On the shaft 26 side, since the bearing 27 side of the gas-transfer chamber 34 is the same pressure as the suction pressure because the oil that has been set to a uniform pressure by the suction pressure is supplied, and the suction port 17 side of the gas-transfer chamber 34 is at the suction pressure, both sides of the gas-transfer chamber 34 filled with the process gas at the discharge pressure are relatively set to low pressures. Therefore, no movements in the process gas and oil from the bearing 27 (low-pressure side) and the suction port 17 (low-pressure side) of the compression chamber 24 toward the gas-transfer chamber 34 (high-pressure side) take place. With these arrangements, shaft-sealing functions for the process gas and oil on the suction port 17 side of the compression chamber 24 of the screw rotor 25 can be achieved.

On the shaft 38 side, between the gas-transfer chamber 47 filled with the process gas at the discharge pressure and the discharge port 18 of the compression chamber 24 at the discharge pressure, since the pressure in the suction port return line 52 is set to relatively a low pressure in comparison with the discharge pressure, as described earlier, the process gas flows toward the suction port return line 52. In other words, since a process gas, leaked in the shaft 38 direction from the discharge portion 18 side of the compression chamber 24, flows into the suction port return line 52, it is possible to prevent leakage toward the bearing 39 side. Between the gas-transfer chamber 47 at the discharge pressure and the above-mentioned bearing 39 at the suction pressure, since the pressure from the gas-transfer chamber 47 toward the bearing 39 side is relatively set to a low pressure, it is possible to prevent the oil supplied to the bearings 39 and 40 from being mixed into the compression chamber 24. With these arrangements, shaft-sealing functions for the process gas and oil on the discharge port 18 side of the compression chamber 24 of the screw rotor 25 can be achieved.

By utilizing the gas compressed by the compressor main unit 11 to be pressure-raised to a discharge pressure as a sealing gas for sealing the inside of the compressor main unit 11, it is possible to further ensure to prevent the lubricating oil from being mixed into the compression chamber 24 and also to prevent the leakage of the process gas toward the bearing 39 side, and consequently to maintain the compression chamber 24 of the screw rotor 25 in an oil-free state.

Figure 3:
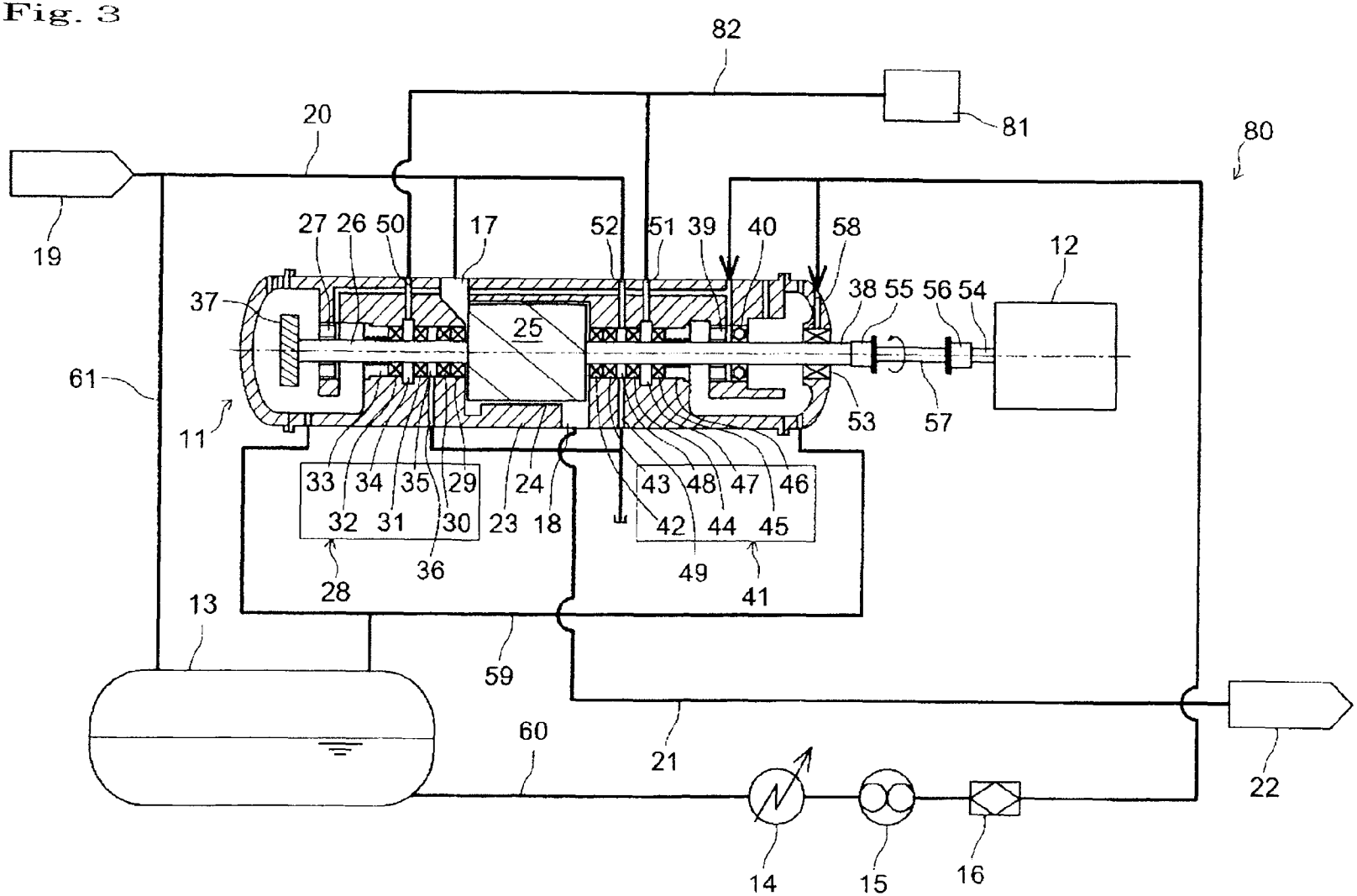
FIG. 3 is a diagram showing an oil-free screw compressor in accordance with a third embodiment of the present invention.
Figure 4:
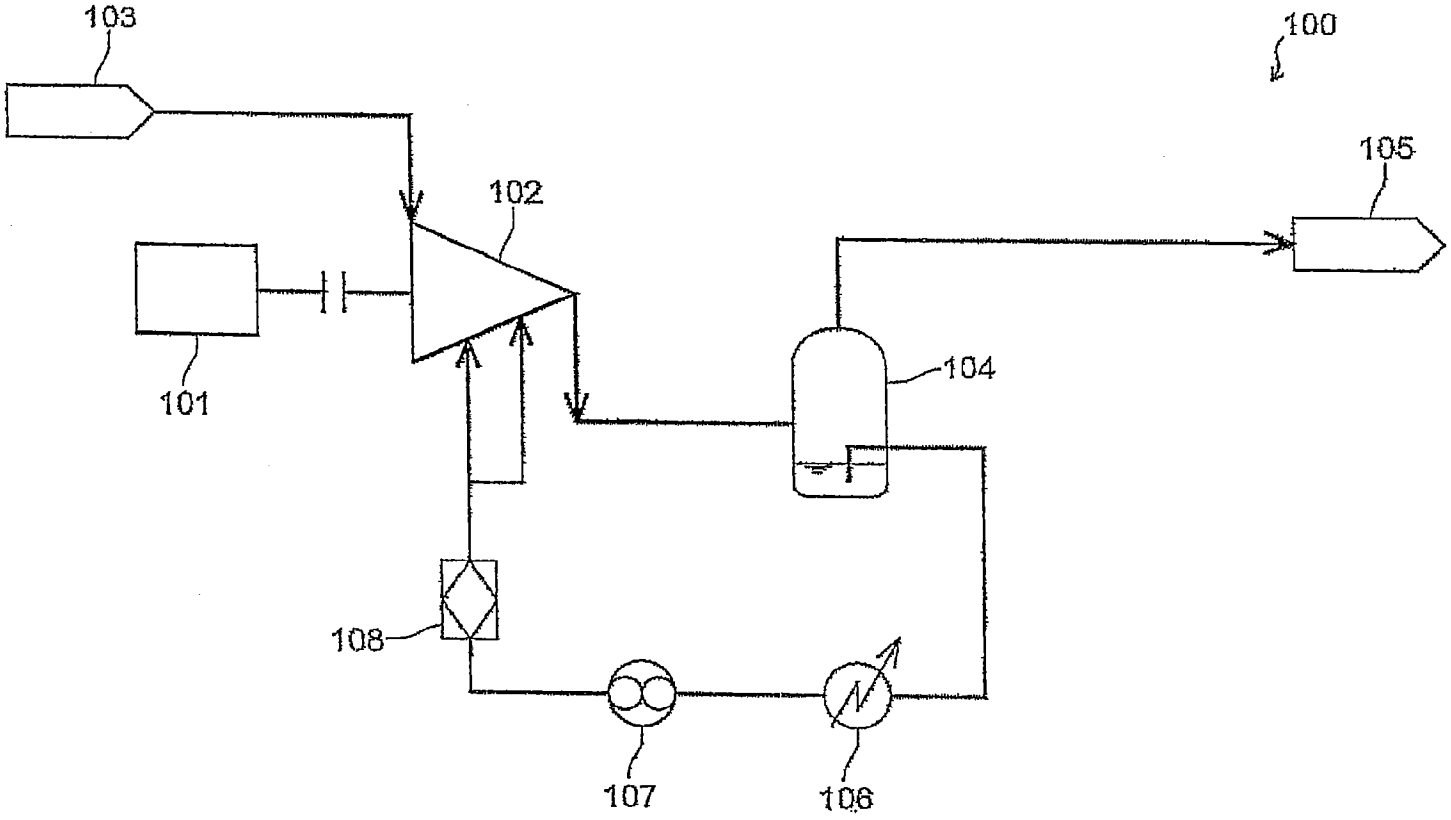
Fig. 4 PRIOR ART
FIG. 4 is a diagram showing a conventional oil-flooded screw compressor.
Figure 5:
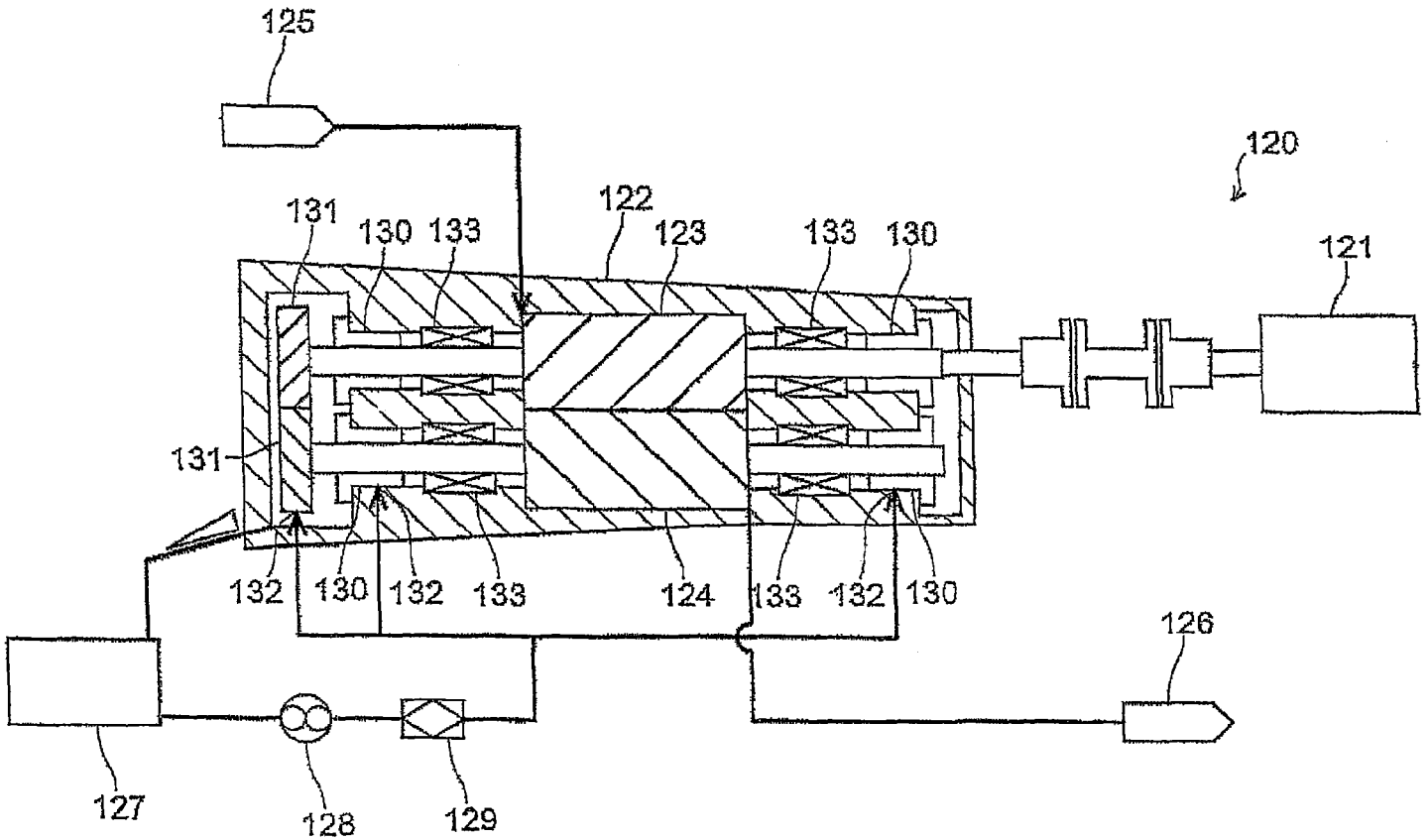
Fig. 5 PRIOR ART
FIG. 5 is a diagram showing a conventional oil-free screw compressor.

FIG. 3 shows an oil-free screw compressor 80 in accordance with a third embodiment of the present invention. In the present embodiment, those components that are the same as those of embodiment 1 are indicated by the same reference numerals and the description thereof will be omitted. In the present embodiment, the gas-transfer line 50 is connected to the gas-transfer chamber 34 in the same manner as in the second embodiment. The gas-transfer line 51 is connected to the gas-transfer chamber 47. The gas-transfer line 50 and the gas-transfer line 51 are connected to an inert-gas supply line 82 to which an inert gas is supplied from an inert-gas supply source 81 used for supplying a nitrogen gas, a fuel gas or the like that gives no influences to the process gas.

In the third embodiment, instead of the process gas having a discharge pressure that is sent to the gas-transfer chambers 34 and 47 in the second embodiment, the inert gas is sent thereto. The same shaft-sealing function as that of the second embodiment is of course obtained, and in the present embodiment, even when a process gas containing a corrosive component is compressed, the process gas is prevented from being made in contact with the bearings 27, 39 and 40 of the compression chamber 24 of the screw rotor 25 so that the lubricating oil can be made less susceptible to degradation.

The invention claimed is:

1. An oil-free screw compressor comprising:

a compressor main unit having a pair of male and female screw rotors that are disposed horizontally, with shafts of the screw rotors being supported by bearings;

an oil supply tank that stores oil;

an oil supply line that supplies the oil in the oil supply tank to oil injection portions including the bearings of the compressor main unit; and an oil recovery line that collects the oil supplied to the oil injection portions to the oil supply tank, wherein the screw compressor further comprises:

shaft-sealing portions that are placed on two sides of a compressor chamber of the screw rotor in an axial direction thereof, and prevent the oil supplied to the oil injection portions from being mixed into the compressor chamber of the screw rotor, as well as preventing a process gas from leaking from the compressor chamber;

a suction port return line that allows the shaft-sealing portion on a discharge side of the compressor chamber and a suction port of the compressor main unit to communicate with each other;

a supply process gas communication line that allows the suction port of the compressor main unit and an upper portion of the oil supply tank to communicate with each other; and an inside/outside shaft-sealing portion that separates an inside of the compressor main unit from atmospheric air.

2. The oil-free screw compressor according to claim 1, further comprising:

a gas-transfer line that transfers a gas flow to the shaft-sealing portions on the two sides, wherein the gas is a gas that is compressed by the compressor main unit having a discharge pressure.

3. The oil-free screw compressor according to claim 1, further comprising:

a gas-transfer line that transfers a gas flow to the shaft-sealing portions on the two sides, wherein the gas is a gas that gives no influences to the process gas.

* * * * *